US006565075B2

(12) United States Patent
Ishizaki

(10) Patent No.: US 6,565,075 B2
(45) Date of Patent: May 20, 2003

(54) ROTATABLE STAPLER WITH POSITION-DETECTION FEATURE

(75) Inventor: Kunio Ishizaki, Tokyo (JP)

(73) Assignee: Max Co., Ltd., Tokyo (JP)

( * ) Notice: Subject to any disclaimer, the term of this patent is extended or adjusted under 35 U.S.C. 154(b) by 18 days.

(21) Appl. No.: 09/815,593

(22) Filed: Mar. 23, 2001

(65) Prior Publication Data

US 2001/0023886 A1 Sep. 27, 2001

(30) Foreign Application Priority Data

Mar. 24, 2000 (JP) ..... 2000-084789

(51) Int. Cl.[7] ..... B25C 5/16

(52) U.S. Cl. ..... 270/58.09; 270/58.08; 399/41; 227/4; 227/8; 227/128

(58) Field of Search ..... 270/58.07, 58.08, 270/58.09; 227/4, 8, 120, 127, 128; 399/410

(56) References Cited

U.S. PATENT DOCUMENTS 4,508,329 A * 4/1985 Hubler et al. ..... 227/120
5,100,119 A * 3/1992 Komada et al. ..... 270/58.14
5,141,143 A 8/1992 Ebner et al.
5,273,199 A * 12/1993 Logtens ..... 227/120
5,806,750 A 9/1998 Yamanushi et al.

FOREIGN PATENT DOCUMENTS

JP 10-180711 * 7/1998
JP 10-180712 * 7/1998

* cited by examiner

*Primary Examiner*—Patrick H. Mackey
(74) *Attorney, Agent, or Firm*—Chapman and Cutler

(57) ABSTRACT

A stapler made with an upside down structure and used in downside up position in which loading of the cartridge is easily attained, is provided. The stapler comprises a base plate 21 which is fixed on a top board 13, a bracket 30 which is rotatably attached to an arm board portion 25 of the base plate 21, a stapler body 40 which is attached to the bracket 30 and a stopper 70 which fixes the stapler body 40 in its downside up posture.

3 Claims, 9 Drawing Sheets

ROTATABLE STAPLER WITH POSITION-DETECTION FEATURE

BACKGROUND OF THE INVENTION

1. Field of the Invention

The present invention relates to a stapler, for example, which is disposed out of online for post processing on copied paper such as a post processing apparatus of the copying machine.

2. Description of the Prior Art

Heretofore there is well known a stapler which is disposed to a copying machine and so on, as shown in FIG. 8.

The stapler of this kind comprises a cartridge K in which a plurality of staples sheets S in multi-layered form is contained, a sending mechanism E by which the sheet of staples S is sent to a driving out portion U, a driver D) which drives out the staple from the driving out portion U by reciprocal movement thereof and a table Z which has a clincher (not shown) to clinch the front end portions of driven out staple. The table Z is arranged to be capable of upward or downward moving in order to put and hold a pile of sheets to be bundled when it locates at upper position. The reference character W is a forming plate to form a staple in U-shape by reciprocal movement with the driver.

The cartridge K is removably attached to a magazine N which is disposed to a main body H as shown in FIG. 9.

The cartridge K is arranged to be loaded into the magazine N of main body H by a slantwise insertion from upward to downward.

The above described typo of stapler (normally positioned type stapler), bundles a pile of copied sheets which are discharged from a copying machine with its copied surface up, by a staple which is driven out from upward to downward.

However, recently a new type of copying machine is getting popular as a main current in which copied sheet is discharged from the copying machine with its copied surface down. In the above described stapler of normally positioned type utilized for such type of copying machine, the structure must be arranged in upside down so that the table Z is positioned over magazine N, and the staple must be driven out from downward to upward to bundle the pile of copied sheets. In such stapler described above, as the cartridge K must be slantwise loaded from downward to upward, the insertion of cartridge becomes very difficult.

To solve this problem, newly designed stapler is proposed in which stapler is arranged so that cartridge K can be loaded by slantwise insertion from upward to downward when the table Z is positioned over the magazine N in order to bundle the pile of copied sheet discharged from the copying machine with its copied surface down, it is referred to as upside down positioned type stapler.

There is an occasion that two of above described upside down positioned type staplers are employed to be arranged so that one of it is disposed inside of the post processing apparatus of copying machine, and another of it is disposed on the post processing apparatus. In this occasion of arrangement, namely two staplers are used. The former stapler A of upside down type which is disposed inside of the post processing apparatus, is used for automatic bundling of copied and discharged sheet, and the latter stapler B of upside down type which is disposed on the post processing apparatus, is used for selective bundling of copied and discharged sheet.

When a pile of copied sheet is bundled with utilizing the stapler B, the copied surface of sheet must not be positioned down because a judgment where the staple is driven into, cannot be made. In such a case bundling of the pile of copied sheets by the stapler B becomes very difficult when the stapler B is an upside down positioned type When in a case that the upside down positioned type stapler is disposed with its downside up as the stapler B, bundling of the pile of copied sheets becomes easy but loading of the cartridge becomes extremely difficult.

When in the case that the normal positioned type stapler is disposed as the stapler B, bundling of the pile of sheets with its copied surface up and loading of the cartridge become very easy. However, because the stapler B is a normal positioned type and the stapler A is an upside down positioned type, two difference types of the stapler are used and new problem of higher cost for parts has arisen.

Moreover, as the types of stapler A and B are different, the cartridges for those types may be often different. In such a case staples which are stored in the cartridges arm different and the piles of copied sheets bundled by the stapler A and the piles of copied sheets bundled by the stapler B give different appearance and not good feeling. Further, a problem has arisen as the types of stapler A and B are different, the clinching methods are different and the piles of copied sheets clinched by the stapler A and the piles of copied sheets clinched by the stapler B give different appearance and not good feeling.

SUMMARY OF THE INVENTION

The object of this invention is to provide a stapler made with an upside down structure in which loading of the cartridge is easily attained even when the stapler is disposed to be used in downside up.

This object of the invention is achieved by a stapler which is made with an upside down structure characterized in that the stapler body is rotatably attached in order for the posture of upside down structure to turn downside up.

DETAILED DESCRIPTION OF THE EMBODIMENT

Hereafter an embodiment of the stapler according to the present invention will be explained with reference to the drawings.

Figure 1:
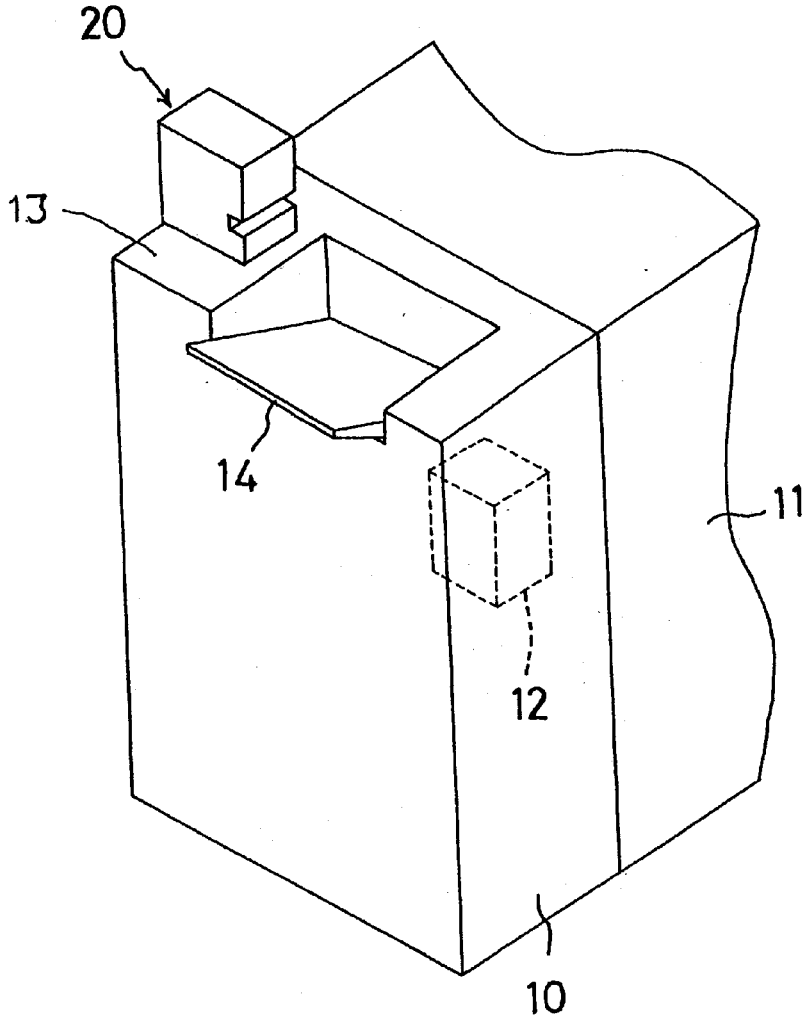
FIG. 1 is an explanatory perspective view of stapler according to the present invention which is disposed to a post processing apparatus of copying machine.

In FIG. 1 reference numeral 10 denotes a post processing apparatus disposed to a body of copying machine 11. In the post processing apparatus 10, an upside down type stapler 12 is disposed for binding a pile of printed sheet which is discharged from the copying machine body 11 with the surface of copied side down. On the top surface of post processing apparatus 10, another upside down type stapler 20 is also provided. A stapler body 40 of the stapler 20 (Refer to FIG. 2 to FIG. 4) has quite the same structure to that of the stapler body of stapler 12 (not shown) because the same kind of stapler is employed.

Figure 2:
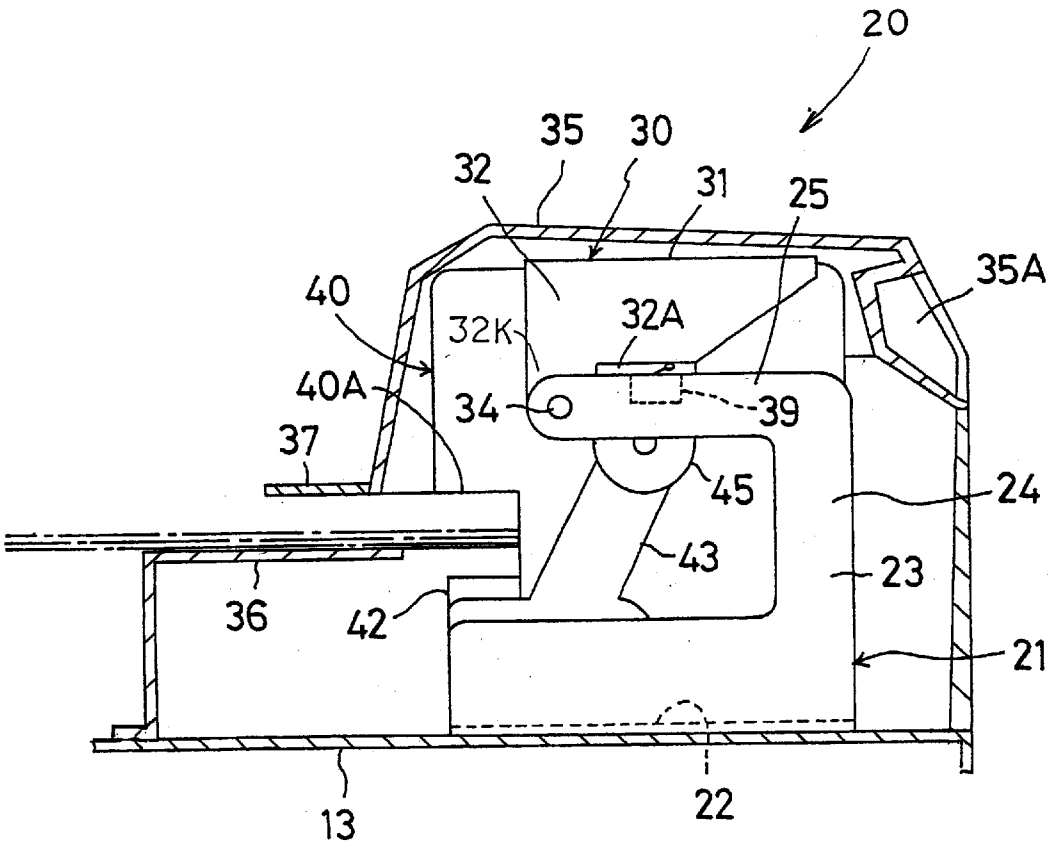
FIG. 2 is an explanatory cross sectional side view to show the relation between stapler body and base plate thereof which are disposed on the top portion of a post processing apparatus.
Figure 3:
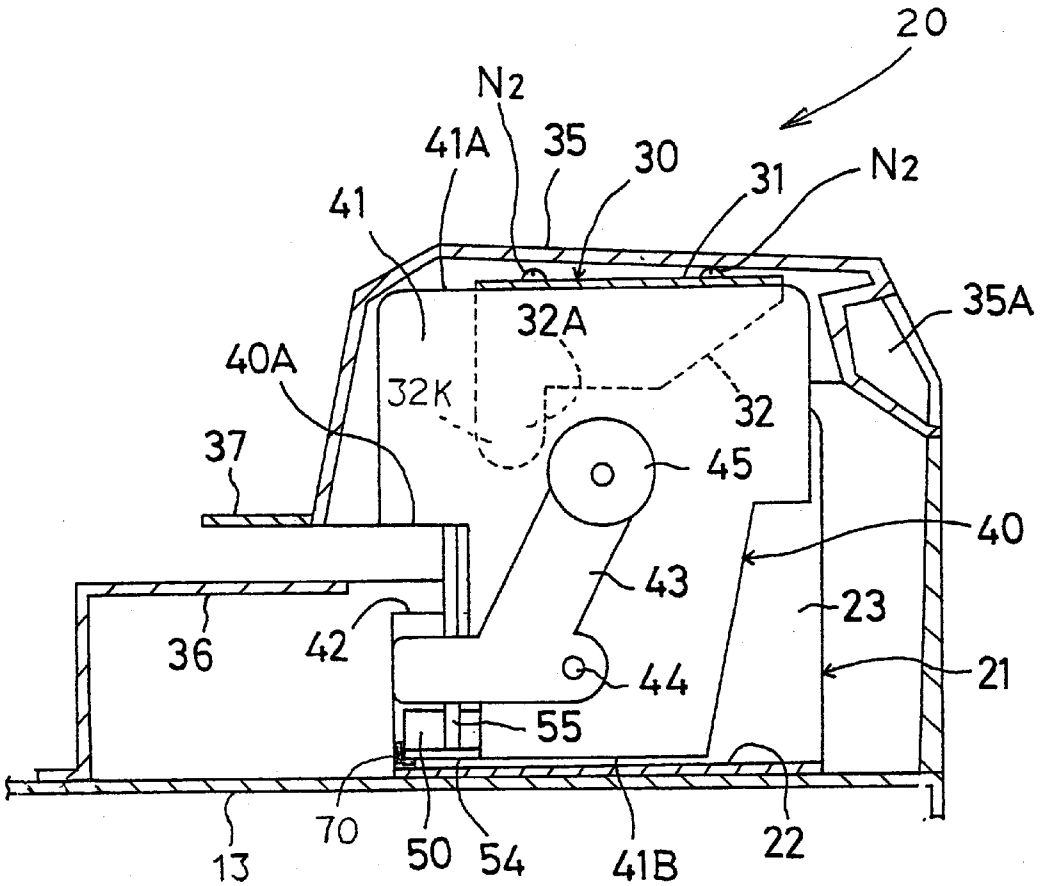
FIG. 3 is an explanatory cross sectional side view to show the stapler body of FIG. 2.
Figure 4:
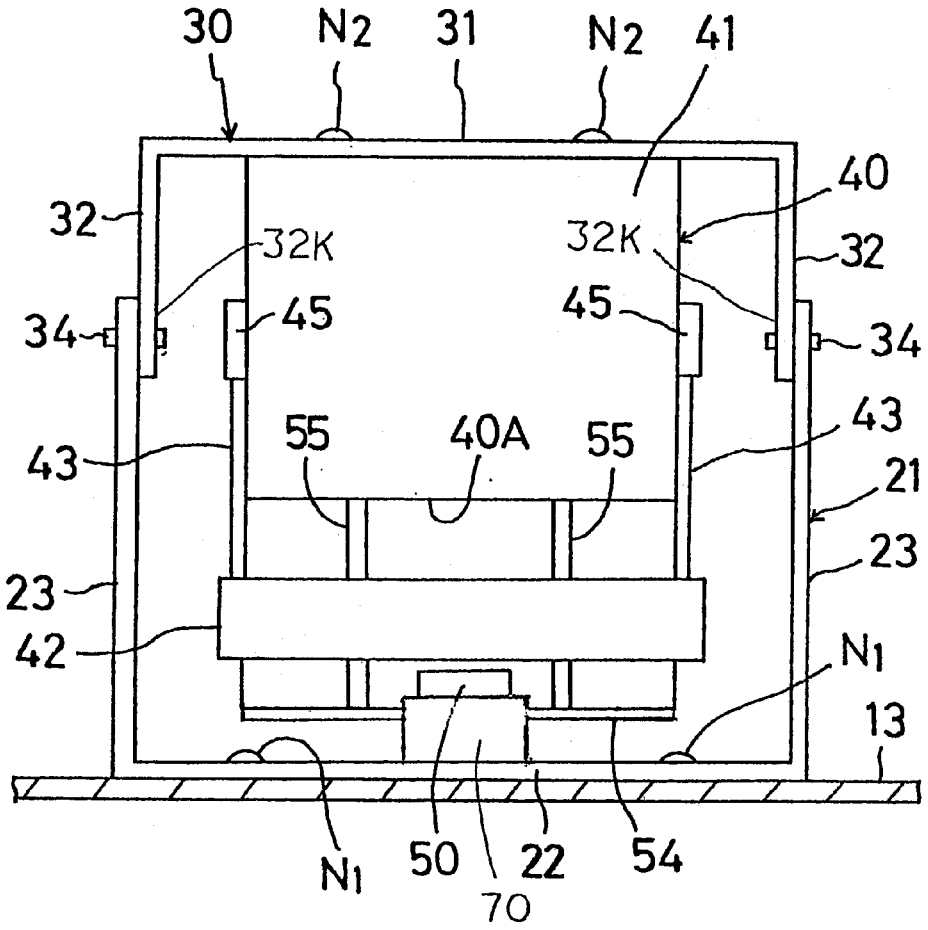
FIG. 4 is a front view to show a stapler body.

As shown in FIG. 2 to FIG. 4, the stapler 20 comprises a base plate 21 which is fixed on a top board 13 of the post process apparatus 10, a bracket 30 which is rotatably attached on the base plate 21, a stapler body 40 which is fixed on the bracket 30 and a cartridge 60 (Refer to FIG. 7) which is removably loaded to the stapler body 40.

The base plate 21 has a base board portion 22 which is fixed by screws N1 on the top board 13 of post processing apparatus 10, and plates 23, 23 are formed which are standing from both ends of the base board portion 22. The plate 23 is formed to have an U-shaped cross section and having support pillar board portion 24 and arm board portion 25 which is extending from upper portion of the support pillar board portion 24 to frontward (leftward in FIG. 2).

The bracket 30 has a flat board portion 31 which is fixed by screws N2 on bottom wall portion 41A of a case 41 of the stapler body 40, and attachment piece 32, 32 are formed to hang over from both ends of the flat board portion 31. Respective lower portions 32K of attachment pieces 32 are supported by a shaft 34 at the front end portion of arm board portion 25 of the base plate 21, and they are rotatable around the shaft 34.

In the above described structure, the stapler body 40 is attached to the base plate 21 in order to turn around the shaft 34, and to be in a posture of downside up.

The stapler body 40 is arranged to be fixed by L-shaped a stopper (fixing means) 70 which is made of magnet on the position shown in FIG. 2 to FIG. 4. The stopper 70 is attached to the base board portion 22 of base plate 21, and magnetically attracts the stapler body 40 facing to contact together with a top portion of support board 54, which is explained later and to fix the stapler body 40. When the stapler body 40 is fixed by the stopper 70 on the position shown in FIG. 2 to FIG. 4, a micro switch (detecting means) 39 is arranged to detect the presence and fixing of the stapler body. The micro switch 39 is disposed at the inside portion of arm board portion 25 of the base plate 21, it is arranged to be turned on by a concave portion 32A of the attachment piece 32 of bracket 30, by this turning on the presence and fixing of stapler body 40 is detected.

An upper cover 35 is attached to the bracket 30, a concave portion 35A is formed at a back portion of the upper cover 35 and for manual operation fingers are put on at the concave portion. The reference numeral 36 denotes a support plate on which a pile of sheets T to be bundled is put, the reference numeral 37 denotes a cover which is attached at upward of the support plate 36, and is fixed on the support plate 36 through a support portion which is not shown.

In the stapler body 40 there are provided a driving mechanism (not shown) which drives sheet of staples (not shown) stored and piled in a cartridge 60 to a driving out portion 40A, a driver (not shown) which forwardly and backwardly reciprocates to drive out the staple from the driving out portion 40A, and a table 42 having a clincher (not shown) which clinches the front end portions of driven out staple.

According to the structure that the stapler body 40 is attached to the base plate 21 in downside up position, the cartridge 60 is disposed over the table 42 and the table 42 is disposed under the cartridge 60, then the staple is driven out from upper side to lower side of the table 42.

Table 42 is arranged to be reciprocated upwardly and downwardly by rotational movement of a link member 43 around a shaft 44. A roller 45 is disposed in upper portion of the link member 43, and a cam which is not shown in the figure, is contacting with the roller 45, then the link member 48 is arranged to rotate around the shaft 44 by the rotational movement of the cam.

Figure 5:
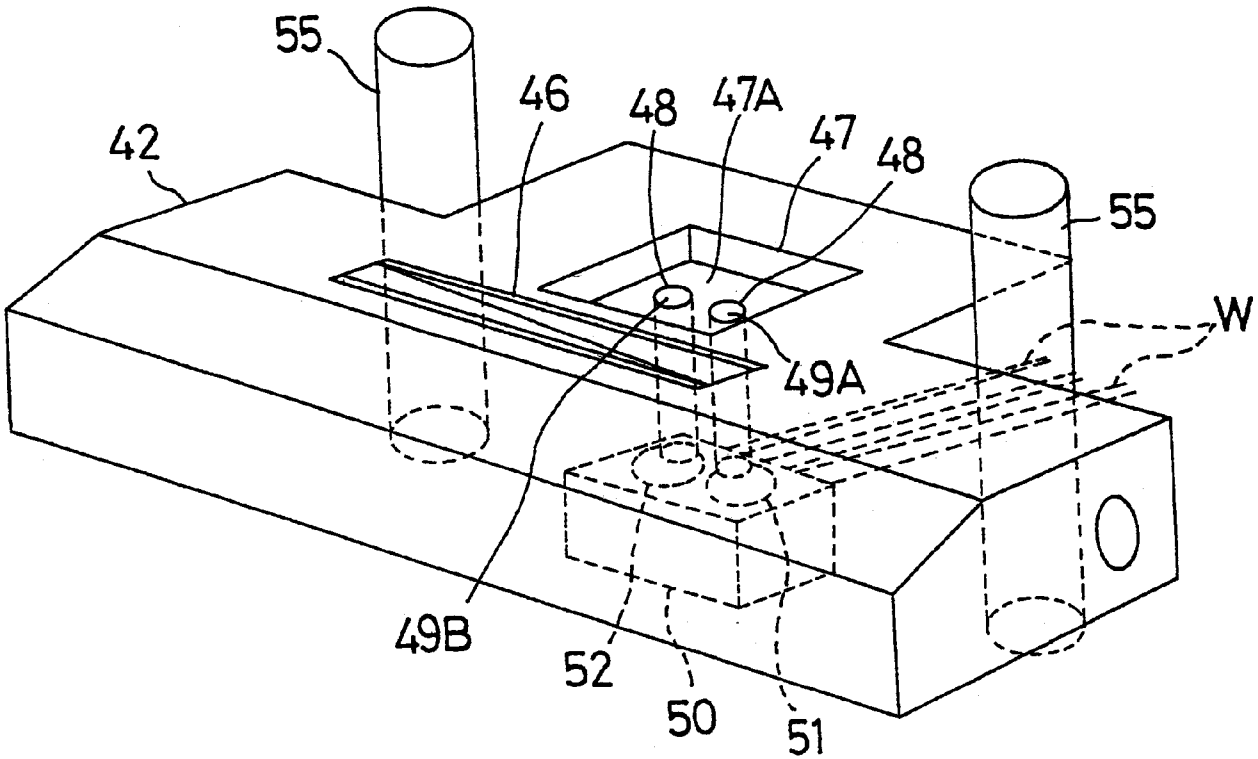
FIG. 5 is a perspective view to show a table.

An opening 46 is formed on the upper surface of table 42 as shown in FIG. 5, into which legs of staple are inserted after penetrating the pile of sheets T to be bundled, and the clincher (not shown) is disposed under the open 46, by which the legs of staple are clinched. A concave portion 47 is formed at the back of opening 46 on the upper surface of table 42 and two through holes 48, 48 are formed in bottom portion 47A of the concave portion 47, and optical fibers 49A, 49B are disposed in the through holes 48, 48.

A photo sensor 50 is disposed at lower part of the table 42 for detecting if a pile of sheets T is put on the table 42 or not. This photo sensor 50 consists of light emission diode 51 and light receiving diode 52, the light emission diode 51 is arranged to confront with a lower end of the optical fiber 49A, and the light receiving diode 52 is arranged to confront with a lower end of the optical fiber 49B. The photo sensor 50 is attached to a support board 64 which is armed so as to project forwardly from a front end of the top board 41B of case 41 of the stapler body 40.

Figure 6:
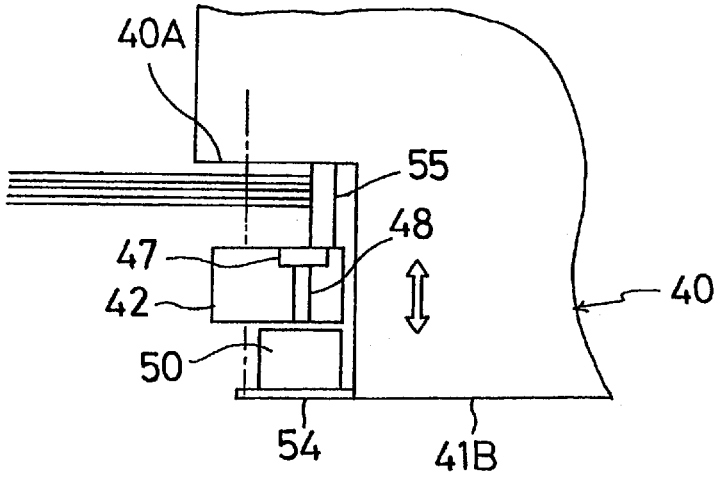
FIG. 6(A) is a side view to show the positional relation among a pile of sheet, table and photo sensor.
FIG. 6(B) is a plan view to show the positional relation among a pile of sheets, table and a photo sensor.
Figure 6:
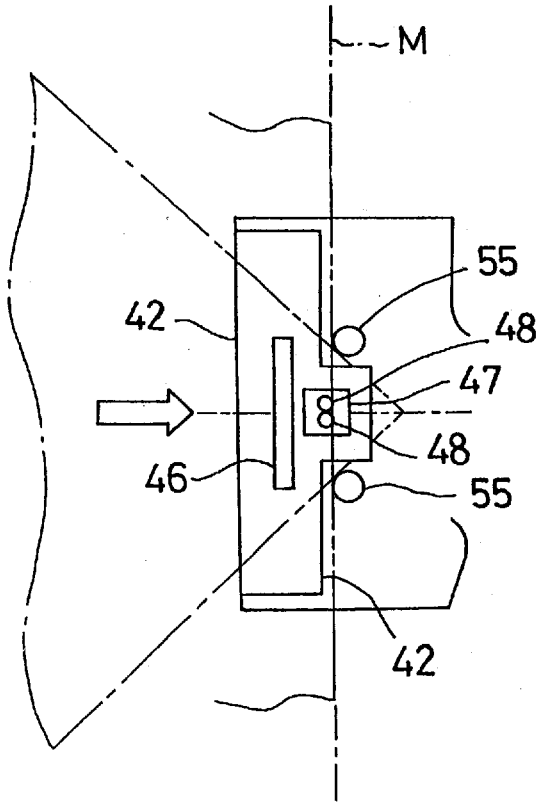

Guide pins 55, 55 are arranged to stand and guide the pile of sheets T as shown in FIG. 6, and the guide pins 55, 55 are located in the positions that the front ends of guide pins are contacting from outside with an extending line of a common tangential line of back ends of the through hole 48 and 48 so that a distance between the guide pins is much larger than that of between the through holes. They are arranged when a pile of sheets T to be bundled is inserted and contacts with both guide pins as shown by the dotted broken line or the double dotted broken line, so that he top surfaces of optical fibers 49A and 49B of through holes 48 and 48 are covered with the sheets and confronts with the bottom surface of the pile of sheets T.

Hereafter the operation of stapler with above described structure will be given.

A copied paper which is processed by the copying machine 11 is discharged to the post process apparatus 10 with the copied surface down. In case when all the copied papers are bundled, the pile of sheets is bundled by stapler 12 as usual in the prior art technique and it goes to be discharged at the discharging tray 14.

In case when all the copied papers are not bundled, the copied paper is discharged at the discharging tray 14 with the copied surface down.

In case when only desired some of the copied paper among all are to be bundled, the desired some of copied papers am put on the support plate 36 with their copied surface up and inserted so as to contact with both guide pins 55 and 55 as shown in FIG. 6(B) by the dotted broken line or the double dotted broken line.

On the other hand, a light emission diode 51 of the photo sensor 50 is lighted and the light beam is projected upward through the optical fiber 49A in the table 42 from the top end of optical fiber 49A. The projected light beam from the top end of optical fiber 49A is reflected by outer surface of the pile of sheets T and enters back to the optical fiber 49B in the table 42. The entered light to the optical fiber 49B is projected from the bottom end of optical fiber 49B and it is received by a light receiving diode 52 of the photo sensor 50.

When the light receiving diode 52 receives the light, the micro switch is turned on, and a control circuit which is not shown in the figure, judges that a pile of sheets T to be bundled is surely put on the support plate 36, then it makes an order to start a motor (not shown) driving. The table 42 goes up by this driving of motor in order for pile of sheets T to be put and held between the table 42 and the drifting out portion 40A. Then a staple is driven out from the driving out portion 40A and the legs of staple penetrate through the pile of sheets T and the legs of staple are clinched by the clincher arranged on the table 42, thus the pile of sheets is bundled by the stapler. The table 42 goes down and returns to its home position after whole process has been completed.

Figure 7:
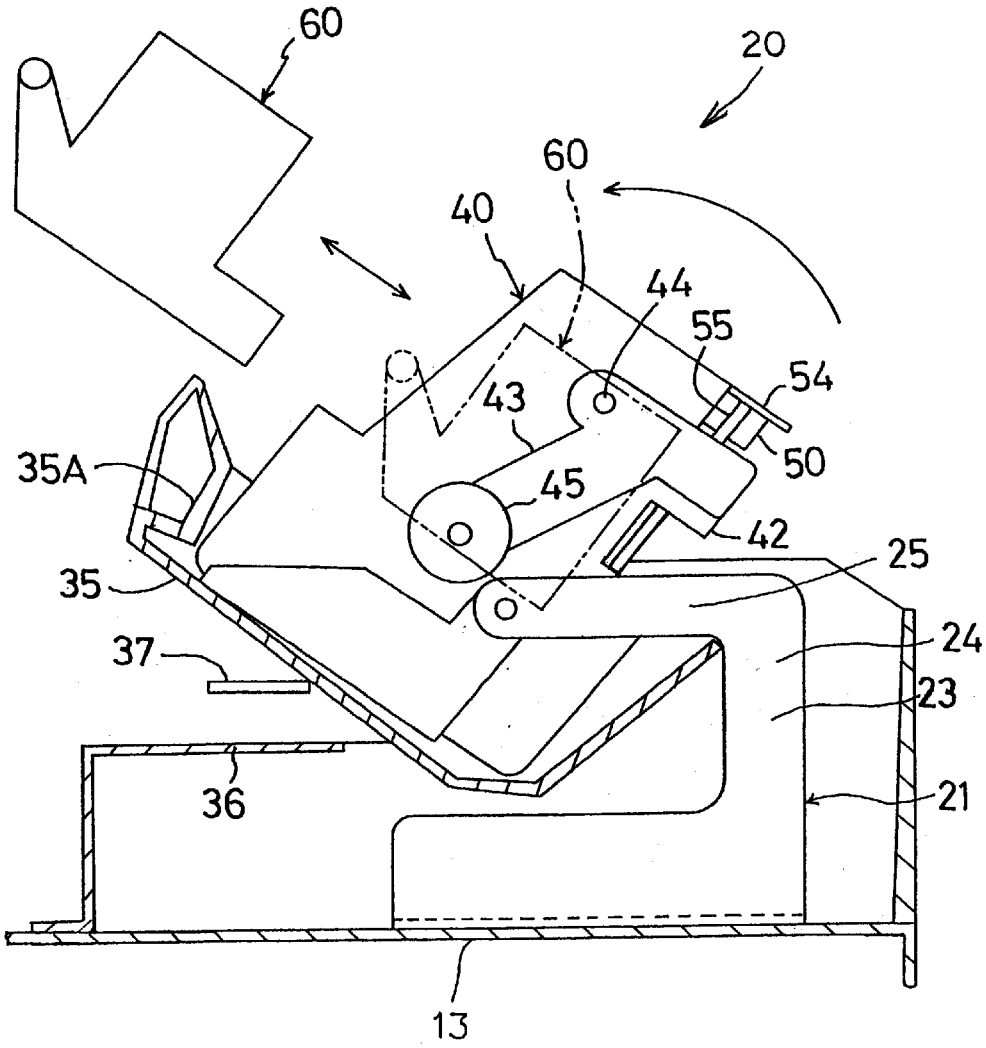
FIG. 7 is an explanatory side view of stapler body which is turned downside up.
Figure 8:
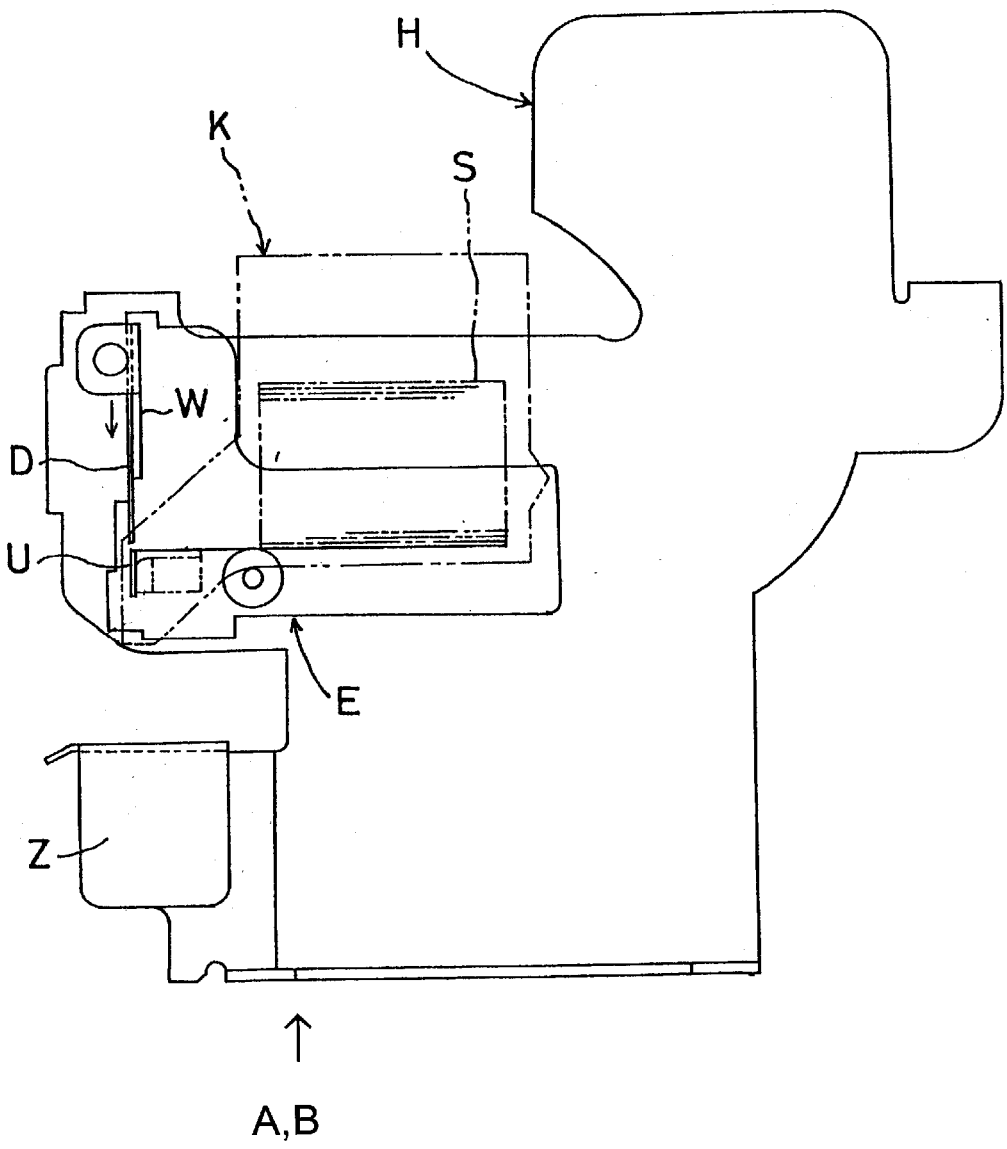
Fig. 8 Prior Art
FIG. 8 is an explanatory side view to show a structure of the stapler in prior art.
Figure 9:
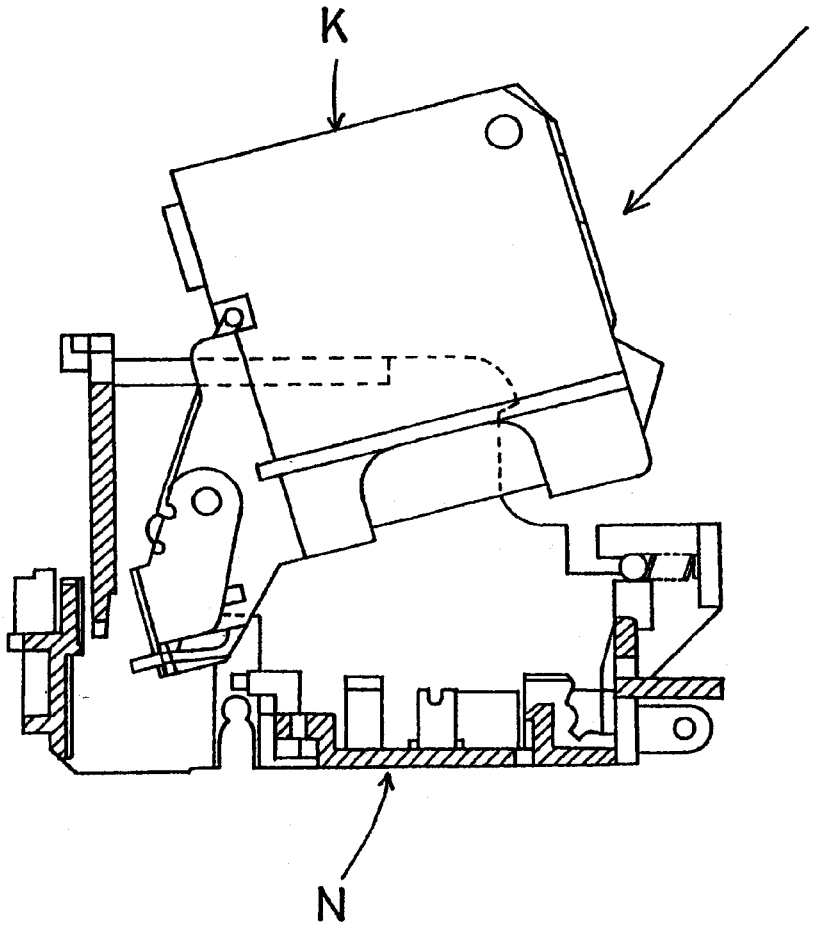
Fig. 9 Prior Art
FIG. 9 is an explanatory side view to show how to load a cartridge into the stapler in prior art.

When the cartridge 60 is exchanged, the support board 64 of stapler body 40 is detached from the stopper 70 and the stapler body 40 is turned around in counter clockwise with enforcing stapler body 40 and the upper cover 35 to turn counter clockwise by handling operation at the convex portion 35A of upper cover 35 as shown in FIG. 7. The stapler body 40 takes a posture upside down. By this motion the stapler body 40 returns to be normal position.

When the stapler body 40 is turned around as shown in FIG. 7, it is fixed at the position by a stopper which is not shown in the figure. Then the cartridge 60 is pulled slantwise out to upward and new cartridge 60 is inserted into the stapler body 40 in order to be loaded.

As described above, the exchange of cartridge 60 is easily attained by inserting slantwise the cartridge 60 to downward into stapler body 40.

When the stapler 40 is in a posture of turning around, because the micro switch 39 is turned to off, it is prevented that the stapler body 40 is driven in error.

After the loading of cartridge 60 is completed, the stapler body 40 is turned again reverse to the above, in clockwise with the upper cover 35 in order to be in the position shown in FIG. 2 to FIG. 4.

As above described even by the upside down positioned type stapler 20 the pile of sheets T can be bundled with its copied surface up, and the loading of cartridge 60 can be easily achieved by turning the stapler body 40. Further, because the same upside down positioned type model of stapler is used for both of the stapler body 40 and stapler body 12, reduction of material cost is achieved, and the same type of stapler and the same way to bundle is used because the same type of cartridge is employed, the appearance of pile of sheets bundled by stapler 12 and by stapler 20 seems to be same and it gives a good feeling.

Moreover, because the photo sensor 50 is attached to the support board 54 of top board 41B of the stapler 40, it is prevented that the lead wire W is extended and loosened together with an upward and downward movement of the table 42. By this structure a cut off problem of the lead wire W with friction does not occur.

Further, because the light is emitted through the optical fiber 49A in the table 42 to the pile of sheets T, the light which is emitted Em the light emission diode 51 of photo sensor 50, can be pretend on the surface of pile of sheets T without being weakened. As the structure is arranged to receive the reflected light from pile of sheets T through the optical fiber 49B in the table 42 by the light receiving diode 52 of photo sensor 50, the reflected light from the pile of sheets T can be received without being weakened. By this fact the detection of pile of sheets T can be surely achieved even when the distance between the photo sensor 50 and the pile of sheets T is much long.

What is claimed is:

1. A stapling apparatus comprising:

a body mounted rotatably on a base plate;

a cartridge in which staples are contained and which is attached detachably in said body;

means for fixing said body in a position; and means for detecting that said body is fixed in a position by said means for fixing.

2. A stapling apparatus according to claim 1, wherein said body is rotated relative to said base plate until said cartridge is positioned in an upward position.

3. A stapling apparatus according to claim 1, wherein driving out of said staples is carried out when said means for detecting detects that said body is fixed in a position.

* * * * *